US010151011B2

(12) United States Patent
Eguchi et al.

(10) Patent No.: US 10,151,011 B2
(45) Date of Patent: Dec. 11, 2018

(54) HIGH-STRENGTH STAINLESS STEEL SEAMLESS TUBE OR PIPE FOR OIL COUNTRY TUBULAR GOODS, AND METHOD OF MANUFACTURING THE SAME

(71) Applicant: JFE Steel Corporation, Tokyo (JP)

(72) Inventors: Kenichiro Eguchi, Tokyo (JP); Yasuhide Ishiguro, Tokyo (JP)

(73) Assignee: JFE Steel Corporation (JP)

( * ) Notice: Subject to any disclaimer, the term of this patent is extended or adjusted under 35 U.S.C. 154(b) by 135 days.

(21) Appl. No.: 14/651,952

(22) PCT Filed: Dec. 19, 2013

(86) PCT No.: PCT/JP2013/007449
§ 371 (c)(1),
(2) Date: Jun. 12, 2015

(87) PCT Pub. No.: WO2014/097628
PCT Pub. Date: Jun. 26, 2014

(65) Prior Publication Data

US 2015/0315684 A1 Nov. 5, 2015

(30) Foreign Application Priority Data

Dec. 21, 2012 (JP) ..... 2012-278815
Oct. 30, 2013 (JP) ..... 2013-225199

(51) Int. Cl.

| | |
|---|---|
| ***C22C 38/04*** | (2006.01) |
| ***C21D 9/08*** | (2006.01) |
| ***C21D 1/18*** | (2006.01) |
| ***C21D 6/00*** | (2006.01) |
| ***C21D 11/00*** | (2006.01) |
| ***C22C 38/02*** | (2006.01) |
| ***C22C 38/00*** | (2006.01) |
| ***C22C 38/44*** | (2006.01) |
| ***C22C 38/54*** | (2006.01) |
| ***C22C 38/06*** | (2006.01) |
| ***C22C 38/42*** | (2006.01) |
| ***C22C 38/46*** | (2006.01) |
| ***C22C 38/48*** | (2006.01) |
| ***C22C 38/50*** | (2006.01) |
| *C21D 8/10* | (2006.01) |

(52) U.S. Cl.

CPC ..... *C21D 9/08* (2013.01); *C21D 1/18* (2013.01); *C21D 6/004* (2013.01); *C21D 6/005* (2013.01); *C21D 6/008* (2013.01); *C21D 9/085* (2013.01); *C21D 11/00* (2013.01); *C22C 38/00* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 8/105* (2013.01)

(58) Field of Classification Search

CPC ..... C22C 38/20; C22C 38/54; C22C 38/50; C22C 38/48; C22C 38/46; C22C 38/44; C22C 38/42; C22C 38/06; C22C 38/04; C22C 38/02; C21D 9/08

See application file for complete search history.

(56) References Cited

U.S. PATENT DOCUMENTS

| | | | |
|---|---|---|---|
| 2006/0243354 | A1 | 11/2006 | Kimura et al. |
| 2011/0226378 | A1 | 9/2011 | Kondo et al. |
| 2012/0031530 | A1 | 2/2012 | Takabe et al. |

FOREIGN PATENT DOCUMENTS

| | | |
|---|---|---|
| CA | 2 795 326 | 11/2011 |
| CN | 1836056 | 9/2006 |
| CN | 1871369 | 11/2006 |
| CN | 101171351 | 4/2008 |
| EA | 200870307 | 2/2009 |
| EP | 1 514 950 | 3/2005 |
| EP | 1 652 950 | 5/2006 |
| EP | 1 681 364 | 7/2006 |
| EP | 1 683 885 | 7/2006 |
| EP | 1 995 341 | 11/2008 |
| EP | 2 857 530 | 4/2015 |

(Continued)

OTHER PUBLICATIONS

English Abstract and English Machine Translation of JP 2007-332431 (Dec. 27, 2007).*

English Abstract and English Machine Translation of Kimura et al. (JP 2012-149317). (dated Aug. 9, 2012).*

Chinese Office Action dated Mar. 25, 2016, of corresponding Chinese Application No. 201380067310.9, along with an English translation of the Search Report.

Supplementary European Search Report dated Feb. 10, 2016 of corresponding European Application No. 13864497.6.

(Continued)

*Primary Examiner* — Jessee R Roe

(74) *Attorney, Agent, or Firm* — DLA Piper LLP (US)

(57) ABSTRACT

A high-strength stainless steel seamless tube or pipe has excellent corrosion resistance, where excellent carbon dioxide gas corrosion resistance in high-temperature environments containing $CO_2$ and $Cl^-$ at high temperatures up to 200° C. and excellent sulfide stress cracking resistance and excellent sulfide stress corrosion cracking resistance at corrosive environments further containing $H_2S$ are ensured based on a composition of C: 0.05% or less, Si: 0.5% or less, Mn: 0.15% to 1.0%, P: 0.030% or less, S: 0.005% or less, Cr: 15.5% to 17.5%, Ni: 3.0% to 6.0%, Mo: 1.5% to 5.0%, Cu: 4.0% or less, W: 0.1% to 2.5%, and N: 0.15% or less such that $-5.9\times(7.82+27C-0.91Si+0.21Mn-0.9Cr+Ni-1.1Mo+0.2Cu+11N)\geq 13.0$ is satisfied.

22 Claims, No Drawings

(56) References Cited

FOREIGN PATENT DOCUMENTS

| | | | | |
|---|---|---|---|---|
| JP | 10-1755 | A | | 1/1998 |
| JP | 2005/336595 | A | | 12/2005 |
| JP | 2007-332431 | | * | 12/2007 |
| JP | 2008-81793 | A | | 4/2008 |
| JP | 2011-252222 | | | 12/2011 |
| JP | 2012-149317 | A | | 8/2012 |
| RU | 2 335 570 | | | 10/2008 |
| WO | 2010/050519 | A1 | | 5/2010 |
| WO | 2010/134498 | A1 | | 11/2010 |
| WO | 2013/190834 | A1 | | 12/2013 |

OTHER PUBLICATIONS

Russian Office Action dated Jun. 14, 2017, of corresponding Russian Application No. 2015129831, along with an English translation.

European Communication dated Sep. 14, 2017, of corresponding European Application No. 13864497.6.

* cited by examiner

HIGH-STRENGTH STAINLESS STEEL SEAMLESS TUBE OR PIPE FOR OIL COUNTRY TUBULAR GOODS, AND METHOD OF MANUFACTURING THE SAME

TECHNICAL FIELD

This disclosure relates to a high-strength stainless steel seamless tube or pipe for oil country tubular goods suitable for use in oil wells, gas wells, and the like of crude oil or natural gases. In particular, the disclosure relates to a high-strength stainless steel seamless tube or pipe having excellent carbon dioxide gas corrosion resistance in very severe corrosion environments containing a carbon dioxide gas ($CO_2$) and chlorine ions ($Cl^-$) at high temperatures, having excellent sulfide stress corrosion cracking resistance (SCC resistance) at high temperatures and excellent sulfide stress cracking resistance (SSC resistance) at normal temperature, in environments containing hydrogen sulfide ($H_2S$), and is suitable for use in oil wells. In this regard, hereafter the term "high strength" refers to the strength of yield strength: 110 ksi grade, i.e., the strength of 758 MPa or more on a yield strength basis.

BACKGROUND

In recent years, from the viewpoint of soaring oil prices and exhaustion of petroleum estimated in the near future, deep oil wells which have not been searched and oil wells, gas wells, and the like in severe corrosive environments at so-called "sour" environments have been actively developed. In general, such oil wells and gas wells have very large depths and the atmospheres thereof are severely corrosive environments containing $CO_2$, $Cl^-$ and, furthermore, $H_2S$ at high temperatures. Oil country tubular goods used in such environments are required to include materials having high strength and excellent corrosion resistance (carbon dioxide gas corrosion resistance, sulfide stress corrosion cracking resistance, and sulfide stress cracking resistance) in combination.

In oil wells and gas wells in environments containing carbon dioxide gas ($CO_2$), chlorine ions ($Cl^-$), and the like, in many cases, 13% Cr martensitic stainless steel tubes or pipes have been employed as oil country tubular goods used for development drilling. In addition, recently, use of improved version 13% Cr martensitic stainless steel has been spread, where C in the component system of 13% Cr martensitic stainless steel is reduced and Ni, Mo, and the like are increased.

For example, Japanese Unexamined Patent Application Publication No. 10-1755 describes an improved version 13% Cr martensitic stainless steel (steel tube or pipe), where the corrosion resistance of the 13% Cr martensitic stainless steel (steel tube or pipe) is improved. The stainless steel (steel tube or pipe) described in Japanese Unexamined Patent Application Publication No. 10-1755 is a martensitic stainless steel having excellent corrosion resistance and excellent sulfide stress corrosion cracking resistance, wherein in the composition of martensitic stainless steel containing 10% to 15% of Cr, C is limited to 0.005% to 0.05%, Ni: 4.0% or more and Cu: 0.5% to 3% are added in combination, 1.0% to 3.0% of Mo is further added, and Nieq is adjusted to −10 or more, and the microstructure is composed of a tempered martensite phase, a martensite phase, and a residual austenite phase, while a total fraction of tempered residual austenite phase and martensite phase is 60% to 90%. It is mentioned that the corrosion resistance and the sulfide stress corrosion cracking resistance are thereby improved in wet carbon dioxide gas environments and in wet hydrogen sulfide environments.

Also, oil wells in corrosive environments at higher temperatures (high temperatures up to 200° C.) have been recently developed. However, there is a problem that predetermined corrosion resistance cannot be stably sufficiently ensured in such high-temperature corrosive environments by the technology described in Japanese Unexamined Patent Application Publication No. 10-1755.

Then, oil country tubular or pipy goods which can be used in such high-temperature corrosive environments and which have excellent corrosion resistance and excellent sulfide stress corrosion cracking resistance have been desired and various martensitic stainless steel tubes or pipes have been proposed.

For example, Japanese Unexamined Patent Application Publication No. 2005-336595 describes a high-strength stainless steel tube or pipe, which has a composition containing, on a percent by mass basis, C: 0.005% to 0.05%, Si: 0.05% to 0.5%, Mn: 0.2% to 1.8%, Cr: 15.5% to 18%, Ni: 1.5% to 5%, Mo: 1% to 3.5%, V: 0.02% to 0.2%, N: 0.01% to 0.15%, and O: 0.006% or less such that Cr, Ni, Mo, Cu, and C satisfy a specific relational equation and Cr, Mo, Si, C, Mn, Ni, Cu, and N satisfy a specific relational equation, which has a microstructure containing a martensite phase as a basic phase and 10% to 60% of ferrite phase on a volume fraction basis or a microstructure further containing 30% or more of austenite phase, and which has excellent corrosion resistance. It is mentioned that a high-strength and, furthermore, high-toughness stainless steel tube or pipe for oil country tubular goods can be thereby stably produced having sufficient corrosion resistance even in severe corrosive environments containing $CO_2$ and $Cl^-$ at high temperatures of 200° C. or higher.

Also, Japanese Unexamined Patent Application Publication No. 2008-81793 describes a high-strength stainless steel tube or pipe for oil country tubular goods having high toughness and excellent corrosion resistance. According to the technology described in Japanese Unexamined Patent Application Publication No. 2008-81793, the steel tube or pipe has a composition containing, on a percent by mass basis, C: 0.04% or less, Si: 0.50% or less, Mn: 0.20% to 1.80%, Cr: 15.5% to 17.5%, Ni: 2.5% to 5.5%, V: 0.20% or less, Mo: 1.5% to 3.5%, W: 0.50% to 3.0%, Al: 0.05% or less, N: 0.15% or less, and O: 0.006% or less such that Cr, Mo, W, and C satisfy a specific relational equation, Cr, Mo, W, Si, C, Mn, Cu, Ni, and N satisfy a specific relational equation, and Mo and W further satisfy a specific relational equation and has a microstructure containing a martensite phase as a basic phase and 10% to 50% of ferrite phase on a volume fraction basis. It is mentioned that a high-strength stainless steel tube or pipe for oil country tubular goods can be thereby stably produced having sufficient corrosion resistance even in severe corrosive environments containing $CO_2$, $Cl^-$ and, furthermore, $H_2S$ at high temperatures.

Also, International Publication No. WO 2010/050519 describes a high-strength stainless steel tube or pipe having excellent sulfide stress cracking resistance and excellent high-temperature carbon dioxide gas corrosion resistance. According to International Publication No. WO 2010/050519, the steel tube or pipe has a composition containing, on a percent by mass basis, C: 0.05% or less, Si: 1.0% or less, Cr: more than 16% and 18% or less, Mo: more than 2% and 3% or less, Cu: 1% to 3.5%, Ni: 3% or more and less than 5%, and Al: 0.001% to 0.1% and containing Mn and N in such a way as to satisfy a specific relational equation in a region of Mn: 1% or less and N: 0.05% or less and has a microstructure containing a martensite phase as a basic phase, 10% to 40% of ferrite phase on a volume fraction basis, and 10% or less of residual austenite phase on a volume fraction basis. It is mentioned that a high-strength stainless steel tube or pipe is thereby produced further having sufficient corrosion resistance even in carbon dioxide gas environments at a high temperature of 200° C., having sufficient sulfide stress corrosion cracking resistance even when the environmental gas temperature is lowered, and having excellent corrosion resistance.

Also, International Publication No. WO 2010/134498 describes a stainless steel tube or pipe for oil country tubular goods having a composition containing, on a percent by mass basis, C: 0.05% or less, Si: 0.5% or less, Mn: 0.01% to 0.5%, P: 0.04% or less, S: 0.01% or less, Cr: more than 16.0% and 18.0% or less, Ni: more than 4.0% and 5.6% or less, Mo: 1.6% to 4.0%, Cu: 1.5% to 3.0%, Al: 0.001% to 0.10%, and N: 0.050% or less such that Cr, Cu, Ni, and Mo satisfy a specific relationship and (C+N), Mn, Ni, Cu, and (Cr+Mo) satisfy a specific relationship, having a microstructure containing a martensite phase and 10% to 40% of ferrite phase on a volume fraction basis, where the ferrite phase has a length of 50 μm from the surface in the thickness direction and the proportion of the ferrite phase intersecting a plurality of virtual line segments aligned in a row at a pitch of 10 μm in the range of 200 μm is more than 85%, and having a yield strength of 758 MPa or more. It is mentioned that a stainless steel tube or pipe for oil country tubular goods is thereby produced having excellent corrosion resistance in high-temperature environments and having excellent SCC resistance at normal temperature.

Along with recent development of oil wells, gas wells, and the like in severe corrosive environments, a steel tube or pipe for oil country tubular goods has been desired to have high strength and excellent corrosion resistance, where excellent carbon dioxide gas corrosion resistance and excellent sulfide stress corrosion cracking resistance (SCC resistance) and sulfide stress cracking resistance (SSC resistance) are ensured in combination even in severe corrosive environments containing $CO_2$, $Cl^-$ and, furthermore, $H_2S$, at high temperatures of 200° C. or higher. However, there is a problem that the SSC resistance in high $H_2S$ partial pressure environments has not yet been ensured sufficiently by even the technologies described in Japanese Unexamined Patent Application Publication No. 2005-336595, Japanese Unexamined Patent Application Publication No. 2008-81793, International Publication No. WO 2010/050519, and International Publication No. WO 2010/134498.

It could therefore be helpful to provide a high-strength stainless steel seamless tube or pipe for oil country tubular goods, having high strength and excellent corrosion resistance, where excellent carbon dioxide gas corrosion resistance, excellent sulfide stress corrosion cracking resistance, and excellent sulfide stress cracking resistance are ensured in combination even in the above-described severe corrosive environments, and a method of manufacturing the same.

In this regard, hereafter the term "high strength" refers to a yield strength: 110 ksi (758 MPa) or more. Also, hereafter the term "excellent carbon dioxide gas corrosion resistance" refers to that a corrosion rate of 0.125 mm/y or less when a test is performed by soaking a specimen in a test solution: 20-percent by mass NaCl aqueous solution (solution temperature: 200° C., $CO_2$ gas atmosphere at 30 atm) held in an autoclave for a soaking period of 336 hours. Also, hereafter the term "excellent sulfide stress corrosion cracking resistance" refers to when a test is performed by soaking a specimen in an aqueous solution in which acetic acid+Na acetate is added to a test solution: 20-percent by mass NaCl aqueous solution (solution temperature: 100° C., atmosphere of $CO_2$ gas at 30 atm and $H_2S$ at 0.1 atm) to adjust the pH to 3.3, held in an autoclave for a soaking period of 720 hours while an applied stress of 100% of the yield stress is applied and cracking does not occur in the specimen after the test. Also, hereafter the term "excellent sulfide stress cracking resistance" refers to when a test is performed by soaking a specimen in an aqueous solution, in which acetic acid+Na acetate is added to a test solution: 20-percent by mass NaCl aqueous solution (solution temperature: 25° C., atmosphere of $CO_2$ gas at 0.9 atm and $H_2S$ at 0.1 atm) to adjust the pH to 3.5, held in an autoclave for a soaking period of 720 hours while an applied stress of 90% of the yield stress is applied and cracking does not occur in the specimen after the test.

SUMMARY

We studied various factors affecting the corrosion resistance of a stainless steel tube or pipe, which has a Cr-containing composition having an increased Cr content of 15.5 percent by mass or more from the viewpoint of the corrosion resistance, in corrosive environments containing $CO_2$, $Cl^-$ and, furthermore, $H_2S$ at higher temperatures up to 200° C. We found that the microstructure was specified to be a multi phase in which a basic phase (primary constituent) was a martensite phase (tempered martensite phase) and a secondary phase was 10% to 60% of ferrite phase, on a volume fraction basis, or the ferrite phase and further contained 30% or less of residual austenite phase, on a volume fraction basis, and thereby, a high-strength stainless steel seamless tube or pipe was able to be produced having excellent carbon dioxide gas corrosion resistance and excellent high-temperature sulfide stress corrosion cracking resistance in combination in high-temperature corrosive environments containing $CO_2$, $Cl^-$ and, furthermore, $H_2S$ at high temperatures up to 200° C. and, in addition, in environments in which a stress close to the yield strength was loaded in a corrosive atmosphere containing $CO_2$, $Cl^-$ and, furthermore, $H_2S$ and that the microstructure was allowed to contain predetermined amounts of Cu, Mo, and W and, thereby, a high-strength stainless steel seamless tube or pipe was produced having excellent sulfide stress cracking resistance in environments with a high $H_2S$ concentration. In this regard, hereafter the term "being a basic phase (primary constituent)" refers to being 40% to 90% on a volume fraction basis.

We also found that to specify the microstructure of the composition containing 15.5 percent by mass or more of Cr to be a predetermined multi phase, first, inclusion of C, Si, Mn, Cr, Ni, Mo, Cu, and N adjusted to satisfy formula (1)

$$-5.9\times(7.82+27C-0.91Si+0.21Mn-0.9Cr+Ni-1.1Mo+0.2Cu+11N)\geq 13.0 \quad (1)$$

(where C, Si, Mn, Cr, Ni, Mo, Cu, and N: content of each element (percent by mass)) was important. In this regard, the left side of formula (1) was an index which indicated the tendency of generation of a ferrite phase and which was experimentally determined. We found that adjustment of the amounts and types of the alloy elements in such a way as to satisfy formula (1) was important to achieve a predetermined multi phase.

Also, we found that Cu, Mo, and W adjusted to satisfy formula (2)

$$Cu+Mo+0.5W\geq 5.8 \quad (2)$$

(where Cu, Mo, and W: content of each element (percent by mass)) were contained and, thereby, the sulfide stress cracking resistance in high $H_2S$ concentration environments was improved. In addition, we found that Cu, Mo, W, Cr, and Ni adjusted to further satisfy formula (3)

$$Cu+Mo+W+Cr+2Ni \leq 34.5 \quad (3)$$

(where Cu, Mo, W, Cr, and Ni: content of each element (percent by mass)) were contained and, thereby, excessive generation of residual austenite was suppressed and predetermined high strength and sulfide stress cracking resistance were able to be ensured.

In this regard, with respect to the fact that excellent carbon dioxide gas corrosion resistance and, in addition, excellent sulfide stress corrosion cracking resistance and excellent sulfide stress cracking resistance can be provided in combination by allowing the composition to have a high Cr content of 15.5 percent by mass or more, specifying the microstructure to be a multi phase in which a basic phase (primary constituent) is a martensite phase and a secondary phase is a ferrite phase or a ferrite phase and a further contained residual austenite phase, and allowing the composition to further contain predetermined amounts or more of Cu, Mo, and W.

The ferrite phase is a phase having excellent pitting corrosion resistance and, moreover, the ferrite phase precipitates in a rolling direction, that is, a tube axial direction, in the form of stratum. Consequently, the direction of a lamellar microstructure becomes parallel to a load stress direction of a sulfide stress cracking test and a sulfide stress corrosion cracking test, that is, cracking proceeds in such a way as to partition the lamellar microstructure. Therefore, proceeding of the cracking is suppressed and the SSC resistance and the SCC resistance are improved.

Meanwhile, excellent carbon dioxide gas corrosion resistance can be ensured by reducing C to 0.05 percent by mass or less and allowing the composition to contain 15.5 percent by mass or more of Cr, 3.0 percent by mass or more of Ni, and 1.5 percent by mass or more of Mo.

We thus provide:

(1) A high-strength stainless steel seamless tube or pipe for oil country tubular goods, having a composition containing C: 0.05% or less, Si: 0.5% or less, Mn: 0.15% to 1.0%, P: 0.030% or less, S: 0.005% or less, Cr: 15.5% to 17.5%, Ni: 3.0% to 6.0%, Mo: 1.5% to 5.0%, Cu: 4.0% or less, W: 0.1% to 2.5%, N: 0.15% or less, and the remainder composed of Fe and incidental impurities, on a percent by mass basis, while adjustment is performed such that C, Si, Mn, Cr, Ni, Mo, Cu, and N satisfy formula (1), $$-5.9\times(7.82+27C-0.91Si+0.21Mn-0.9Cr+Ni-1.1Mo+0.2Cu+11N) \geq 13.0 \quad (1)$$

(where C, Si, Mn, Cr, Ni, Mo, Cu, and N: content of each element (percent by mass)) Cu, Mo, and W further satisfy formula (2), $$Cu+Mo+0.5W \geq 5.8 \quad (2)$$

(where Cu, Mo, and W: content of each element (percent by mass)) and Cu, Mo, W, Cr, and Ni further satisfy formula (3), $$Cu+Mo+W+Cr+2Ni \leq 34.5 \quad (3)$$

(where Cu, Mo, W, Cr, and Ni: content of each element (percent by mass)).

(2) A high-strength stainless steel seamless tube or pipe for oil country tubular goods, having a composition containing C: 0.05% or less, Si: 0.5% or less, Mn: 0.15% to 1.0%, P: 0.030% or less, S: 0.005% or less, Cr: 15.5% to 17.5%, Ni: 3.0% to 6.0%, Mo: 1.5% to 5.0%, Cu: 3.5% or less, W: 2.5% or less, N: 0.15% or less, and the remainder composed of Fe and incidental impurities, on a percent by mass basis, while adjustment is performed such that C, Si, Mn, Cr, Ni, Mo, Cu, and N satisfy formula (1), $$-5.9\times(7.82+27C-0.91Si+0.21Mn-0.9Cr+Ni-1.1Mo+0.2Cu+11N) \geq 13.0 \quad (1)$$

(where C, Si, Mn, Cr, Ni, Mo, Cu, and N: content of each element (percent by mass)) Cu, Mo, and W further satisfy formula (2), $$Cu+Mo+0.5W \geq 5.8 \quad (2)$$

(where Cu, Mo, and W: content of each element (percent by mass)) and Cu, Mo, W, Cr, and Ni further satisfy formula (4), $$Cu+Mo+W+Cr+2Ni \leq 31 \quad (4)$$

(where Cu, Mo, W, Cr, and Ni: content of each element (percent by mass)).

Alternatively, the item (2) translates into the high-strength stainless steel seamless tube or pipe for oil country tubular goods, according to the item (1), wherein Cu: 3.5% or less and W: 2.5% or less are contained and Cu, Mo, W, Cr, and Ni further satisfy formula (3), where the value of the right side is 31.

(3) The high-strength stainless steel seamless tube or pipe for oil country tubular goods, according to the item (1) or item (2), wherein the composition further contains V: 0.02% to 0.20% on a percent by mass basis.

(4) The high-strength stainless steel seamless tube or pipe for oil country tubular goods, according to any one of the items (1) to (3), wherein the composition further contains Al: 0.10% or less on a percent by mass basis.

(5) The high-strength stainless steel seamless tube or pipe for oil country tubular goods, according to any one of the items (1) to (4), wherein the composition further contains at least one selected from the group consisting of Nb: 0.02% to 0.50%, Ti: 0.02% to 0.16%, Zr: 0.50% or less, and B: 0.0030% or less on a percent by mass basis.

(6) The high-strength stainless steel seamless tube or pipe for oil country tubular goods, according to any one of the items (1) to (5), wherein the composition further contains at least one selected from the group consisting of REM: 0.005% or less, Ca: 0.005% or less, and Sn: 0.20% or less on a percent by mass basis.

(7) The high-strength stainless steel seamless tube or pipe for oil country tubular goods, according to any one of the items (1) to (6), further having a microstructure including a martensite phase as a basic phase and 10% to 60% of ferrite phase, on a volume fraction basis, as a secondary phase.

(8) The high-strength stainless steel seamless tube or pipe for oil country tubular goods, according to the item 7, wherein the microstructure further includes 30% or less of residual austenite phase on a volume fraction basis.

(9) A method of manufacturing a high-strength stainless steel seamless tube or pipe for oil country tubular goods, including the steps of heating a stainless steel seamless tube or pipe having a composition containing C: 0.05% or less, Si: 0.5% or less, Mn: 0.15% to 1.0%, P: 0.030% or less, S: 0.005% or less, Cr: 15.5% to 17.5%, Ni: 3.0% to 6.0%, Mo: 1.5% to 5.0%, Cu: 4.0% or less, W: 0.1% to 2.5%, N: 0.15% or less, and the remainder composed of Fe and incidental impurities, on a percent by mass basis, while adjustment is performed such that C, Si, Mn, Cr, Ni, Mo, Cu, and N satisfy formula (1), $$-5.9\times(7.82+27C-0.91Si+0.21Mn-0.9Cr+Ni-1.1Mo+0.2Cu+11N) \geq 13.0 \quad (1)$$

(where C, Si, Mn, Cr, Ni, Mo, Cu, and N: content of each element (percent by mass)) Cu, Mo, and W further satisfy formula (2), $$Cu+Mo+0.5W \geq 5.8 \quad (2)$$

(where Cu, Mo, and W: content of each element (percent by mass)) and Cu, Mo, W, Cr, and Ni further satisfy formula (3)

$$Cu+Mo+W+Cr+2Ni \leq 34.5 \quad (3)$$

(where Cu, Mo, W, Cr, and Ni: content of each element (percent by mass)) to a heating temperature of 850° C. or higher, performing a quenching treatment to cool to a temperature of 50° C. or lower at a cooling rate higher than or equal to the air cooling rate, and performing a tempering treatment to heat to a temperature lower than or equal to the $A_{c1}$ transformation temperature and cool.

(10) A method of manufacturing a high-strength stainless steel seamless tube or pipe for oil country tubular goods, including the steps of heating a stainless steel seamless tube or pipe having a composition containing C: 0.05% or less, Si: 0.5% or less, Mn: 0.15% to 1.0%, P: 0.030% or less, S: 0.005% or less, Cr: 15.5% to 17.5%, Ni: 3.0% to 6.0%, Mo: 1.5% to 5.0%, Cu: 3.5% or less, W: 2.5% or less, N: 0.15% or less, and the remainder composed of Fe and incidental impurities, on a percent by mass basis, while adjustment is performed such that C, Si, Mn, Cr, Ni, Mo, Cu, and N satisfy formula (1), $$-5.9\times(7.82+27C-0.91Si+0.21Mn-0.9Cr+Ni-1.1Mo+0.2Cu+11N) \geq 13.0 \quad (1)$$

(where C, Si, Mn, Cr, Ni, Mo, Cu, and N: content of each element (percent by mass)) Cu, Mo, and W further satisfy formula (2), $$Cu+Mo+0.5W \geq 5.8 \quad (2)$$

(where Cu, Mo, and W: content of each element (percent by mass)) and Cu, Mo, W, Cr, and Ni further satisfy formula (4), $$Cu+Mo+W+Cr+2Ni \leq 31 \quad (4)$$

(where Cu, Mo, W, Cr, and Ni: content of each element (percent by mass)) to a heating temperature of 850° C. or higher, performing a quenching treatment to cool to a temperature of 50° C. or lower at a cooling rate higher than or equal to the air cooling rate, and performing a tempering treatment to heat to a temperature lower than or equal to the $A_{c1}$ transformation temperature and cool.

(11) The method of manufacturing a high-strength stainless steel seamless tube or pipe for oil country tubular goods, according to the item (9) or item (10), wherein the composition further contains V: 0.02% to 0.20% on a percent by mass basis.

(12) The method of manufacturing a high-strength stainless steel seamless tube or pipe for oil country tubular goods, according to any one of the items (9) to (11), wherein the composition further contains Al: 0.10% or less on a percent by mass basis.

(13) The method of manufacturing high-strength stainless steel seamless tube or pipe for oil country tubular goods, according to any one of the items (9) to (12), wherein the composition further contains at least one selected from the group consisting of Nb: 0.02% to 0.50%, Ti: 0.02% to 0.16%, Zr: 0.50% or less, and B: 0.0030% or less on a percent by mass basis.

(14) The method of manufacturing a high-strength stainless steel seamless tube or pipe for oil country tubular goods, according to any one of the items (9) to (13), wherein the composition further contains at least one selected from the group consisting of REM: 0.005% or less, Ca: 0.005% or less, and Sn: 0.20% or less on a percent by mass basis.

A high-strength stainless steel seamless tube or pipe having a composition containing 15.5 percent by mass or more of Cr and having excellent corrosion resistance in severe corrosive environments containing $CO_2$, $Cl^-$ and, furthermore, $H_2S$ at high temperatures of 200° C. or higher can be produced relatively inexpensively so that industrially considerably advantageous effects are exerted.

DETAILED DESCRIPTION

A high-strength stainless steel seamless tube or pipe for oil country tubular goods has a composition containing C: 0.05% or less, Si: 0.5% or less, Mn: 0.15% to 1.0%, P: 0.030% or less, S: 0.005% or less, Cr: 15.5% to 17.5%, Ni: 3.0% to 6.0%, Mo: 1.5% to 5.0%, Cu: 4.0% or less, W: 0.1% to 2.5%, N: 0.15% or less, and the remainder composed of Fe and incidental impurities, on a percent by mass basis, while adjustment is performed such that C, Si, Mn, Cr, Ni, Mo, Cu, and N satisfy formula (1), $$-5.9\times(7.82+27C-0.91Si+0.21Mn-0.9Cr+Ni-1.1Mo+0.2Cu+11N) \geq 13.0 \quad (1)$$

(where C, Si, Mn, Cr, Ni, Mo, Cu, and N: content of each element (percent by mass)) Cu, Mo, and W further satisfy formula (2), $$Cu+Mo+0.5W \geq 5.8 \quad (2)$$

(where Cu, Mo, and W: content of each element (percent by mass)) and Cu, Mo, W, Cr, and Ni further satisfy formula (3), $$Cu+Mo+W+Cr+2Ni \leq 34.5 \quad (3)$$

(where Cu, Mo, W, Cr, and Ni: content of each element (percent by mass)).

Also, a high-strength stainless steel seamless tube or pipe for oil country tubular goods has a composition containing C: 0.05% or less, Si: 0.5% or less, Mn: 0.15% to 1.0%, P: 0.030% or less, S: 0.005% or less, Cr: 15.5% to 17.5%, Ni: 3.0% to 6.0%, Mo: 1.5% to 5.0%, Cu: 3.5% or less, W: 2.5% or less, N: 0.15% or less, and the remainder composed of Fe and incidental impurities, on a percent by mass basis, while adjustment is performed such that C, Si, Mn, Cr, Ni, Mo, Cu, and N satisfy formula (1), $$-5.9\times(7.82+27C-0.91Si+0.21Mn-0.9Cr+Ni-1.1Mo+0.2Cu+11N) \geq 13.0 \quad (1)$$

(where C, Si, Mn, Cr, Ni, Mo, Cu, and N: content of each element (percent by mass)) Cu, Mo, and W further satisfy formula (2), $$Cu+Mo+0.5W \geq 5.8 \quad (2)$$

(where Cu, Mo, and W: content of each element (percent by mass)) and Cu, Mo, W, Cr, and Ni further satisfy formula (4), $$Cu+Mo+W+Cr+2Ni \leq 31 \quad (4)$$

(where Cu, Mo, W, Cr, and Ni: content of each element (percent by mass)).

To begin with, reasons for specifying the components of the compositions of the steel tube or pipe will be described. Hereafter "percent by mass" is simply expressed as "%" unless otherwise specified.

C: 0.05% or Less

Carbon is an important element to increase the strength of a martensitic stainless steel. The content of 0.005% or more is desirable to ensure predetermined strength. On the other hand, if the content is more than 0.05%, the carbon dioxide gas corrosion resistance and the sulfide stress corrosion cracking resistance are degraded. Therefore, C is 0.05% or less. In this regard, 0.005% to 0.04% is preferable.

Si: 0.5% or Less

Silicon is an element functioning as a deoxidizing agent, and the content of 0.1% or more is desirable for this purpose. On the other hand, if the content is more than 0.5%, the hot workability is degraded. Therefore, Si is 0.5% or less. In this regard, 0.2% to 0.3% is preferable.

Mn: 0.15% to 1.0%

Manganese is an element that increases the strength of a steel. It is necessary that the content be 0.15% or more to ensure predetermined strength. On the other hand, if the content is more than 1.0%, the toughness is degraded. Therefore, Mn is 0.15% to 1.0%. In this regard, 0.2% to 0.5% is preferable.

P: 0.030% or Less

Phosphorus degrades the corrosion resistance, e.g., carbon dioxide gas corrosion resistance, pitting corrosion resistance, and sulfide stress cracking resistance and, therefore, is preferably minimized. However, 0.030% or less is allowable. Consequently, P is 0.030% or less. In this regard, 0.020% or less is preferable.

S: 0.005% or Less

Sulfur is an element that significantly degrades hot workability and hinders stable operation of a pipe production process and, therefore, is preferably minimized. However, when the content is 0.005% or less, the pipe can be produced by a common process. Consequently, S is 0.005% or less. In this regard, 0.002% or less is preferable.

Cr: 15.5% to 17.5%

Chromium is an element that forms a protective film and, thereby, contributes to an improvement of the corrosion resistance. It is necessary that the content be 15.5% or more to ensure the predetermined corrosion resistance. On the other hand, if the content is more than 17.5%, the ferrite fraction becomes too high and predetermined high strength cannot be ensured. Consequently, Cr is 15.5% to 17.5%. In this regard, 15.8% to 16.8% is preferable.

Ni: 3.0% to 6.0%

Nickel is an element having a function of strengthening a protective film and enhancing corrosion resistance. Also, Ni enhances the strength of a steel through solute strengthening. Such effects become considerable when the content is 3.0% or more. On the other hand, if the content is more than 6.0%, stability of the martensite phase is degraded and strength is reduced. Consequently, Ni is 3.0% to 6.0%. In this regard, 3.5% to 5.0% is preferable.

Mo: 1.5% to 5.0%

Molybdenum is an element that enhances resistance to pitting corrosion due to $Cl^-$ and low pH and enhances sulfide stress cracking resistance and sulfide stress corrosion cracking resistance. Consequently, the content of 1.5% or more is necessary. If the content is less than 1.5%, the corrosion resistance in severe corrosive environments is somewhat less than sufficient. On the other hand, Mo is an expensive element, and a large content of more than 5.0% causes soaring of production cost and, in addition, a chi phase ($\chi$ phase) precipitates to degrade the toughness and the corrosion resistance. Therefore, Mo is 1.5% to 5.0%. In this regard, 3.0% to 5.0% is preferable.

Cu: 4.0% or Less

Copper is an important element to strengthen a protective film, suppress hydrogen penetration into a steel, and enhance the sulfide stress cracking resistance and the sulfide stress corrosion cracking resistance. The content of 0.3% or more is desirable to obtain such effects. On the other hand, if the content is more than 4.0%, grain boundary precipitation of CuS is caused and hot workability is degraded. Consequently, Cu is 4.0% or less. The content is preferably 3.5% or less, and further preferably 2.0% or less. On the other hand, the lower limit of Cu is preferably 0.3%, further preferably 0.5%, and more preferably 1.5%.

W: 2.5% or Less

Tungsten is a very important element to contribute to enhancement of the strength of a steel and, in addition, enhance sulfide stress corrosion cracking resistance and sulfide stress cracking resistance. When W is contained in combination with Mo, the sulfide stress cracking resistance is enhanced. The content of 0.1% or more is preferable to obtain such effects. On the other hand, if the content is large and more than 2.5%, toughness is degraded. Consequently, W is 2.5% or less. The content is preferably 0.1% to 2.5%, and further preferably 0.8% to 1.2%.

N: 0.15% or Less

Nitrogen is an element that significantly improves pitting corrosion resistance. Such an effect becomes considerable when the content is 0.01% or more. On the other hand, if the content is more than 0.15%, various nitrides are formed and the toughness is degraded. Consequently, N is 0.15% or less. In this regard, 0.01% to 0.07% is preferable.

The above-described ranges of the above-described components are contained and, in addition, C, Si, Mn, Cr, Ni, Mo, Cu, and N are contained to satisfy formula (1).

$$-5.9\times(7.82+27C-0.91Si+0.21Mn-0.9Cr+Ni-1.1Mo+0.2Cu+11N)\geq 13.0 \quad (1)$$

The left side of formula (1) is determined as an index which indicates the tendency of generation of a ferrite phase. When the alloy elements shown in formula (1) are adjusted to satisfy formula (1) and are contained, a multi phase in which a basic phase is a martensite phase and a secondary phase is a ferrite phase or a ferrite phase and a further contained residual austenite phase can be realized as the microstructure of a final product stably. Consequently, the amount of each alloy element is adjusted to satisfy formula (1). In this regard, when an alloy element described in formula (1) is not specifically contained, the value of the left side of formula (1) is discussed where the content of the element concerned is regarded as zero percent.

Also, the above-described ranges of the above-described components are contained and, in addition, Cu, Mo, and W are adjusted to satisfy formula (2)

$$Cu+Mo+0.5W\geq 5.8 \quad (2)$$

(where Cu, Mo, and W: content of each element (percent by mass)) and are contained. The left side of formula (2) is newly determined as an index which indicates the tendency of sulfide stress cracking resistance. If the value of left side of formula (2) is less than 5.8, stability of a passivation film is insufficient and predetermined sulfide stress cracking resistance cannot be ensured. Consequently, Cu, Mo, and W are adjusted to satisfy formula (2) and are contained.

Also, the above-described ranges of the above-described components are contained and, in addition, Cu, Mo, W, Cr, and Ni are adjusted to satisfy formula (3)

$$Cu+Mo+W+Cr+2Ni\leq 34.5 \quad (3)$$

(where Cu, Mo, W, Cr, and Ni: content of each element (percent by mass)) and are contained. The left side of formula (3) is newly determined as an index which indicates the tendency of generation of residual austenite. If the value of left side of formula (3) is large and more than 34.5, predetermined high strength cannot be ensured because residual austenite becomes excessive. In addition, the sulfide stress cracking resistance and the sulfide stress corrosion cracking resistance are degraded. Consequently, Cu, Mo, W, Cr, and Ni are adjusted to satisfy formula (3) and are contained. In this regard, the value of left side of formula (3) is specified to be preferably 32.5 or less, and more preferably 31 or less.

The remainder other than the above-described components is composed of Fe and incidental impurities. As for incidental impurities, O (oxygen): 0.01% or less is allowable.

The above-described components are basic components. At least one group of the following Groups (A) to (D) can be further contained as selective elements besides the basic components.

Group (A): V: 0.02% to 0.20% on a percent by mass basis

Group (B): Al: 0.10% or less on a percent by mass basis

Group (C): at least one selected from the group consisting of Nb: 0.02% to 0.50%, Ti: 0.02% to 0.16%, Zr: 0.50% or less, and B: 0.0030% or less on a percent by mass basis Group (D): at least one selected from the group consisting of REM: 0.005% or less, Ca: 0.005% or less, and Sn: 0.20% or less on a percent by mass basis Group (A): V: 0.02% to 0.20%

Vanadium is an element that enhances the strength of a steel through precipitation strengthening. The content of 0.02% or more is desirable to obtain such an effect. On the other hand, if the content is more than 0.20%, toughness is degraded. Consequently, V is preferably 0.02% to 0.20%. In this regard, 0.04% to 0.08% is more preferable.

Group (B): Al: 0.10% or Less

Aluminum is an element that functions as a deoxidizing agent, and to obtain such an effect, the content of 0.01% or more is desirable. On the other hand, if the content is large and is more than 0.10%, amounts of oxides become excessive and toughness is adversely affected. Consequently, when Al is contained, the content is preferably 0.10% or less, and more preferably 0.02% to 0.06%.

Group (C): at least one selected from the group consisting of Nb: 0.02% to 0.50%, Ti: 0.02% to 0.16%, Zr: 0.50% or less, and B: 0.0030% or less Each of Nb, Ti, Zr, and B is an element to contribute to enhance the strength and can be selected and contained as necessary.

Niobium contributes to the above-described enhancement of strength and, in addition, further contributes to an improvement of the toughness. The content of 0.02% or more is preferable to obtain such effects. On the other hand, if the content is more than 0.50%, toughness is degraded. Consequently, when Nb is contained, the content is preferably 0.02% to 0.50%.

Titanium contributes to the above-described enhancement of strength and, in addition, further contributes to an improvement of the sulfide stress cracking resistance. The content of 0.02% or more is preferable to obtain such effects. On the other hand, if the content is more than 0.16%, coarse precipitates are generated and the toughness and the sulfide stress corrosion cracking resistance are degraded. Consequently, when Ti is contained, the content is preferably 0.02% to 0.16%.

Zirconium contributes to the above-described enhancement of strength and, in addition, further contributes to an improvement of the sulfide stress corrosion cracking resistance. The content of 0.02% or more is desirable to obtain such effects. On the other hand, if the content is more than 0.50%, toughness is degraded. Consequently, when Zr is contained, the content is preferably 0.50% or less.

Boron contributes to the above-described enhancement of strength and, in addition, further contributes to an improvement of the hot workability. The content of 0.0005% or more is desirable to obtain such effects. On the other hand, if the content is more than 0.0030%, the toughness and the hot workability are degraded. Consequently, when B is contained, the content is preferably 0.0030% or less.

Group (D): at least one selected from the group consisting of REM: 0.005% or less, Ca: 0.005% or less, and Sn: 0.20% or less Each of REM, Ca, and Sn is an element to contribute to an improvement of the sulfide stress corrosion cracking resistance and can be selected and contained as necessary. It is desirable that REM: 0.001% or more, Ca: 0.001% or more, and Sn: 0.05% or more be contained to obtain such effects. On the other hand, even when REM: more than 0.005%, Ca: more than 0.005%, and Sn: more than 0.20% are contained, the effect is saturated, an effect commensurate with the content cannot be expected, and there is an economic disadvantage. Consequently, when they are contained, the individual contents are preferably REM: 0.005% or less, Ca: 0.005% or less, and Sn: 0.20% or less.

Next, reasons for specifying the microstructure of the high-strength stainless steel seamless tube or pipe for oil country tubular goods will be described.

It is preferable that the high-strength stainless steel seamless tube or pipe for oil country tubular goods have the above-described composition and, in addition, have a multi phase in which a basic phase is a martensite phase (tempered martensite phase) and a secondary phase is 10% to 60% of ferrite phase on a volume fraction basis. Alternatively, it is preferable that the high-strength stainless steel seamless tube or pipe have the above-described composition and, in addition, have a multi phase in which a basic phase is a martensite phase (tempered martensite phase) and a secondary phase is 10% to 60% of ferrite phase on a volume fraction basis and, furthermore, 30% or less of residual austenite phase on a volume fraction basis.

To ensure predetermined high strength of the seamless tube or pipe, it is preferable that the basic phase is specified to be a martensite phase (tempered martensite phase).

Then, to ensure predetermined corrosion resistance (carbon dioxide gas corrosion resistance, sulfide stress cracking resistance (SSC resistance), and sulfide stress corrosion cracking resistance (SCC resistance)), it is preferable that 10% to 60% of ferrite phase on a volume fraction basis be precipitated as at least the secondary phase and, thereby, a two-phase microstructure composed of 40% to 90% of martensite phase (tempered martensite phase) and the ferrite phase be established. Consequently, a lamellar microstructure is formed in a tube axial direction and cracking is suppressed. If the ferrite phase is less than 10%, the above-described lamellar microstructure is not formed and in some cases, predetermined improvement of the corrosion resistance is not obtained. On the other hand, if the ferrite phase precipitates in a large amount more than 60%, it may become difficult to ensure predetermined high strength. Consequently, the volume fraction of ferrite phase serving as the secondary phase is favorably 10% to 60%. In this regard, 20% to 50% is preferable.

Also, besides the ferrite phase, 30% or less of residual austenite phase on a volume fraction basis may be precipitated as the secondary phase. The presence of the residual austenite phase improves ductility and toughness. Such effects can be ensured when the volume fraction is preferably 5% or more and 30% or less. If the amount of the residual austenite phase increases and the volume fraction becomes more than 30%, it may become difficult to ensure predetermined high strength. In this regard, the basic phase refers to that the volume fraction is 40% to 90%.

Next, a preferable method of manufacturing the high-strength stainless steel seamless tube or pipe for oil country tubular goods will be described.

The starting material is a stainless steel seamless tube or pipe having the above-described composition. A method of manufacturing the stainless steel seamless tube or pipe serving as the starting material is not necessarily specifically limited and any commonly known method of manufacturing a seamless tube or pipe can be applied.

Preferably, a molten steel having the above-described composition is produced by a common melting practice, e.g., a steel converter furnace, and steel tube or pipe raw materials, e.g., a billet, are produced by common methods, e.g., continuous casting and ingot casting-blooming method. Subsequently, the resulting steel tube or pipe raw material is heated and the hot tube or pipe making is performed by using a tube or pipe making process of Mannesmann-plug mill method or Mannesmann-mandrel mill method, which is a common pipe making method, so that a steel seamless tube or pipe having a predetermined size and the above-described composition is produced.

After pipe formation, preferably, the steel seamless tube or pipe is cooled to room temperature at a cooling rate higher than or equal to the air cooling rate. Consequently, a steel tube or pipe microstructure, in which the basic phase of the microstructure is specified to be a martensite phase, is ensured. In this regard, a steel seamless tube or pipe may be produced by hot extruding on the basis of a press method.

Following the cooling to room temperature at a cooling rate higher than or equal to the air cooling rate after the pipe making, heating is further performed to a heating temperature of 850° C. or higher. Thereafter, a quenching treatment to cool to a temperature of 50° C. or lower at a cooling rate higher than or equal to the air cooling rate is performed. Consequently, a steel seamless tube or pipe having a microstructure in which the basic phase is a martensite phase and an appropriate amount of ferrite phase is included can be produced.

If the heating temperature of the quenching treatment is lower than 850° C., predetermined high strength cannot be ensured. In this regard, the heating temperature of the quenching treatment is specified to be preferably 1,150° C. or lower from the viewpoint of preventing coarsening of the microstructure, and more preferably 900° C. to 1,100° C.

When the quenching treatment to cool to a temperature of 50° C. or lower at a cooling rate higher than or equal to the air cooling rate is performed, a martensite phase is precipitated and, thereby, predetermined high strength can be obtained.

Then, the quenching-treated steel seamless tube or pipe is subjected to a tempering treatment to heat to a temperature lower than or equal to the $A_{c1}$ transformation temperature and cool (natural cooling). When the tempering treatment to heat to a temperature lower than or equal to the $A_{c1}$ transformation temperature and cool is performed, the microstructure is made into a microstructure composed of a tempered martensite phase, a ferrite phase, and, in addition, a residual austenite phase (residual γ phase). Consequently, a high-strength stainless steel seamless tube or pipe having predetermined high strength and further having high toughness and excellent corrosion resistance is produced. If the tempering temperature becomes high and is higher than the $A_{c1}$ transformation temperature, as-quenched martensite is generated and predetermined high strength, high toughness, and excellent corrosion resistance cannot be ensured. In this regard, more preferably, the tempering temperature is specified to be 700° C. or lower, and preferably 550° C. or higher.

Our steel compositions, pipes, tubes, and methods will be further described below with reference to the examples.

EXAMPLES

Molten steels having the compositions shown in Table 1-1 and Table 1-2 were produced by a steel converter and cast into billets (steel tube or pipe raw materials) by a continuous casting method. Pipe making was performed through hot working by using a model seamless rolling mill and, thereby, a steel seamless tube or pipe having outside diameter 83.8 mm×thickness 12.7 mm was produced. In this regard, air cooling was performed after pipe formation.

A specimen of raw material was cut from the resulting steel seamless tube or pipe and subjected to a quenching treatment to heat and, thereafter, cool under the conditions shown in Table 2-1 and Table 2-2. Subsequently, a tempering treatment to heat and air-cool under the conditions shown in Table 2-1 and Table 2-2 was performed.

A specimen for microstructure observation was taken from the specimen of raw material subjected to the above-described quenching-tempering treatment. The specimen for microstructure observation was corroded with a Vilella reagent (picric acid 1 g, hydrochloric acid 5 ml, ethanol 100 ml) and the microstructure was photographed with a scanning electron microscope (magnification 1,000 times). The microstructure fraction (percent by volume) of the ferrite phase was calculated by using image analyzation equipment.

Also, the microstructure fraction of the residual austenite phase was measured by using an X-ray diffraction method). A specimen for measurement was taken from the specimen of raw material subjected to the quenching-tempering treatment, and X-ray diffraction integrated intensity of each of a (220) face of γ and a (211) face of α was measured on the basis of X-ray diffraction and conversion was performed by using the following formula.

$$\gamma\ (\text{volume fraction})=100/(1+(I\alpha R\gamma/I\gamma R\alpha))$$

where Iα: integrated intensity of α

Rα: crystallographically theoretically calculated value of α

Iγ: integrated intensity of γ

Rγ: crystallographically theoretically calculated value of γ

In this regard, the fraction of the martensite phase was calculated as the remainder other than these phases.

A strip specimen specified by API standard 5CT was taken from the specimen of raw material subjected to the quenching-tempering treatment. A tensile test in conformity with the specification of API was performed and, thereby, tensile characteristics (yield strength YS, tensile strength TS) were determined.

Also, a V-notch specimen (thickness 10 mm) was taken from the specimen of raw material subjected to the quenching-tempering treatment in conformity with the specification of JIS Z 2242, a charpy impact test was performed and, thereby, absorbed energy at −10° C. was determined, so that toughness was evaluated.

In addition, a specimen of thickness 3 mm×width 30 mm×length 40 mm for corrosion test was produced from the specimen of raw material subjected to the quenching-tempering treatment through mechanical working and the corrosion test was performed.

The corrosion test was performed by soaking the specimen into a test solution: 20 percent by mass NaCl aqueous solution (solution temperature: 200° C., $CO_2$ gas atmosphere at 30 atm) held in an autoclave and specifying the soaking period to be 14 days. The weight of the specimen after the test was measured and the corrosion rate was determined by calculation on the basis of weight reduction between before and after the corrosion test. Also, presence or absence of an occurrence of pitting corrosion of the specimen surface after the corrosion test was observed by using a loupe having magnification: 10 times. In this regard, "presence" refers to when pitting corrosion has diameter: 0.2 mm or more.

Also, a round-bar specimen (diameter: 6.4 mmφ) was produced through mechanical working in conformity with NACE TM0177 Method A from the specimen of raw material subjected to the quenching-tempering treatment and a SSC resistance test was performed.

Also, a specimen of thickness 3 mm×width 15 mm×length 115 mm for four-point bending was taken through mechanical working from the specimen of raw material subjected to the quenching-tempering treatment and a SCC resistance test was performed.

The SCC resistance test was performed by soaking a specimen in an aqueous solution in which acetic acid+Na acetate was added to a test solution: 20-percent by mass NaCl aqueous solution (solution temperature: 100° C., atmosphere of $H_2S$: 0.1 atm and $CO_2$: 30 atm) to adjust to pH: 3.3, held in an autoclave for a soaking period of 720 hours while an applied stress of 100% of the yield stress was applied. Presence of cracking in the specimen after the test was examined.

The SSC resistance test was performed by soaking a specimen in an aqueous solution in which acetic acid+Na acetate is added to a test solution: 20-percent by mass NaCl aqueous solution (solution temperature: 25° C., atmosphere of $H_2S$: 0.1 atm and $CO_2$: 0.9 atm) to adjust to pH: 3.5, for a soaking period of 720 hours while an applied stress of 90% of the yield stress was applied. Presence of cracking in the specimen after the test was examined.

The obtained results are shown in Table 2-1 and Table 2-2.

TABLE 1-1

| Steel | Chemical component (percent by mass) | | | | | | | |
|---|---|---|---|---|---|---|---|---|
| No. | C | Si | Mn | P | S | Cr | Ni | Mo |
| A | 0.012 | 0.18 | 0.31 | 0.022 | 0.0007 | 16.3 | 3.46 | 2.96 |
| B | 0.013 | 0.15 | 0.30 | 0.023 | 0.0010 | 15.5 | 3.44 | 2.80 |
| C | 0.009 | 0.16 | 0.29 | 0.018 | 0.0007 | 16.0 | 3.58 | 3.01 |
| D | 0.009 | 0.16 | 0.31 | 0.022 | 0.0009 | 15.9 | 3.50 | 3.37 |
| E | 0.013 | 0.16 | 0.31 | 0.021 | 0.0008 | 16.9 | 3.57 | 2.91 |
| F | 0.012 | 0.19 | 0.30 | 0.025 | 0.0007 | 16.4 | 3.88 | 2.96 |
| G | 0.010 | 0.19 | 0.29 | 0.018 | 0.0006 | 14.4 | 5.32 | 2.54 |
| H | 0.020 | 0.20 | 0.30 | 0.020 | 0.0010 | 16.0 | 3.51 | 1.83 |
| I | 0.039 | 0.24 | 0.28 | 0.011 | 0.0010 | 15.8 | 3.74 | 1.40 |
| J | 0.013 | 0.28 | 0.33 | 0.008 | 0.0010 | 16.6 | 4.40 | 2.18 |
| K | 0.019 | 0.27 | 0.25 | 0.009 | 0.0012 | 16.5 | 3.93 | 2.31 |
| L | 0.008 | 0.36 | 0.46 | 0.008 | 0.0009 | 12.3 | 6.25 | 2.35 |
| M | 0.025 | 0.26 | 0.31 | 0.019 | 0.0006 | 16.6 | 6.55 | 2.47 |
| N | 0.010 | 0.19 | 0.31 | 0.015 | 0.0008 | 15.8 | 3.83 | 3.10 |
| O | 0.009 | 0.19 | 0.31 | 0.018 | 0.0011 | 15.8 | 4.26 | 3.70 |
| P | 0.009 | 0.17 | 0.25 | 0.015 | 0.0010 | 15.6 | 4.30 | 3.68 |

| Steel | Chemical component (percent by mass) | | | | | | | |
|---|---|---|---|---|---|---|---|---|
| No. | Cu | W | N | V | Al | Nb, Ti, Zr, B | REM, Ca, Sn | Remarks |
| A | 2.77 | 0.90 | 0.012 | — | — | — | — | Adaptation example |
| B | 2.94 | 0.88 | 0.009 | 0.052 | — | — | Sn: 0.11 | Adaptation example |
| C | 2.92 | 0.89 | 0.010 | — | 0.010 | — | Ca: 0.0024 | Adaptation example |
| D | 2.82 | 0.96 | 0.010 | 0.049 | 0.010 | Ti: 0.048, B: 0.0017 | REM: 0.022, Ca: 0.0019, Sn: 0.09 | Adaptation example |
| E | 2.64 | 0.96 | 0.011 | 0.052 | 0.008 | Zr: 0.11 | — | Adaptation example |
| F | 2.41 | 0.91 | 0.009 | 0.050 | 0.007 | Nb: 0.11, Ti: 0.050, Zr: 0.08, B: 0.0021 | REM: 0.0024, Ca: 0.0018 | Adaptation example |
| G | 1.93 | 0.94 | 0.009 | 0.056 | 0.019 | Ti: 0.049, Zr: 0.11, B: 0.0021 | REM: 0.0019, Ca: 0.0019 | Comparative example |
| H | — | 0.79 | 0.056 | 0.047 | 0.016 | Zr: 0.09, B: 0.0021 | REM: 0.0020, Ca: 0.0020 | Comparative example |
| I | — | 1.13 | 0.050 | 0.061 | 0.012 | Ti: 0.044, B: 0.0008 | — | Comparative example |
| J | — | 1.06 | 0.046 | 0.069 | 0.012 | Ti: 0.034, B: 0.0010 | — | Comparative example |
| K | 2.31 | — | 0.003 | 0.049 | 0.028 | Ti: 0.033 | Ca: 0.0019 | Comparative example |

TABLE 1-1-continued

| | | | | | | | | |
|---|---|---|---|---|---|---|---|---|
| L | 0.30 | — | 0.008 | — | 0.019 | Ti: 0.101 | — | Comparative example |
| M | 1.49 | 0.91 | 0.048 | 0.050 | 0.053 | Nb: 0.10 | — | Comparative example |
| N | 3.04 | 0.85 | 0.012 | 0.051 | 0.023 | — | — | Adaptation example |
| O | 3.54 | 0.89 | 0.010 | 0.052 | 0.021 | — | — | Adaptation example |
| P | 3.84 | 0.89 | 0.008 | 0.054 | 0.017 | — | — | Adaptation example |

TABLE 1-2

| Steel | Formula (1)* | | Formula (2)** | | Formula (3)*** | | |
|---|---|---|---|---|---|---|---|
| No. | Left side value | Adaptation | Left side value | Adaptation | Left side value | Adaptation | Remarks |
| A | 36.8 | ○ | 6.2 | ○ | 29.9 | ○ | Adaptation example |
| B | 31.2 | ○ | 6.2 | ○ | 29.0 | ○ | Adaptation example |
| C | 35.1 | ○ | 6.4 | ○ | 30.0 | ○ | Adaptation example |
| D | 37.7 | ○ | 6.7 | ○ | 30.1 | ○ | Adaptation example |
| E | 39.1 | ○ | 6.0 | ○ | 30.6 | ○ | Adaptation example |
| F | 35.5 | ○ | 5.8 | ○ | 30.4 | ○ | Adaptation example |
| G | 14.7 | ○ | 4.9 | × | 30.5 | ○ | Comparative example |
| H | 26.4 | ○ | 2.2 | × | 25.6 | ○ | Comparative example |
| I | 19.9 | ○ | 2.0 | × | 25.8 | ○ | Comparative example |
| J | 29.7 | ○ | 2.7 | × | 28.6 | ○ | Comparative example |
| K | 29.0 | ○ | 4.6 | × | 29.0 | ○ | Comparative example |
| L | −3.2 | × | 2.7 | × | 27.5 | ○ | Comparative example |
| M | 14.5 | ○ | 4.4 | × | 34.6 | × | Comparative example |
| N | 32.7 | ○ | 6.6 | ○ | 30.5 | ○ | Adaptation example |
| O | 33.9 | ○ | 7.7 | ○ | 32.5 | ○ | Adaptation example |
| P | 32.2 | ○ | 8.0 | ○ | 32.6 | ○ | Adaptation example |

*$-5.9 \times (7.82 + 27\,C - 0.91\,Si + 0.21\,Mn - 0.9\,Cr + Ni - 1.1\,Mo + 0.20\,Cu + 11N) \geq 13.0$ (1)

**$Cu + Mo + 0.5\,W \geq 5.8$ (2)

***$Cu + Mo + W + Cr + 2Ni \geq 34.5$ (3)

TABLE 2-1

| Steel | | Quenching treatment | | | | Tempering treatment | | Microstructure | | | |
|---|---|---|---|---|---|---|---|---|---|---|---|
| tube or pipe No. | Steel No. | Heating temperature (° C.) | Holding time (min) | Quenching cooling rate* (° C./sec.) | Cooling stop temperature (° C.) | Heating temperature (° C.) | Holding time (min) | Type** | F phase volume fraction (%) | Residual γ phase volume fraction (%) | Remarks |
| 1 | A | 980 | 20 | 25 | 25 | 620 | 30 | M + F + γ | 26 | 5 | Invention example |
| 2 | B | 980 | 20 | 25 | 25 | 620 | 30 | M + F + γ | 28 | 5 | Invention example |
| 6 | C | 980 | 20 | 25 | 25 | 620 | 30 | M + F + γ | 31 | 5 | Invention example |
| 7 | D | 1000 | 20 | 25 | 25 | 620 | 30 | M + F + γ | 35 | 11 | Invention example |
| 8 | E | 980 | 20 | 25 | 25 | 620 | 30 | M + F + γ | 32 | 8 | Invention example |
| 9 | F | 980 | 20 | 25 | 25 | 620 | 30 | M + F + γ | 39 | 5 | Invention example |
| 10 | G | 960 | 15 | 25 | 25 | 615 | 30 | M + F + γ | 20 | 5 | Comparative example |
| 11 | H | 920 | 60 | 25 | 25 | 600 | 30 | M + F + γ | 15 | 8 | Comparative example |
| 12 | I | 920 | 60 | 25 | 25 | 600 | 30 | M + F + γ | 8 | 6 | Comparative example |
| 13 | J | 920 | 60 | 25 | 25 | 600 | 30 | M + F + γ | 17 | 9 | Comparative example |
| 14 | K | 980 | 15 | 25 | 25 | 540 | 30 | M + F + γ | 23 | 2 | Comparative example |
| 15 | L | 920 | 15 | 25 | 25 | 525 | 30 | M + γ | 0 | 13 | Comparative example |
| 16 | M | 990 | 20 | 0.5 | 25 | 550 | 30 | M + F + γ | 16 | 66 | Comparative example |

TABLE 2-1-continued

| Steel tube or pipe No. | Steel No. | Quenching treatment: Heating temperature (° C.) | Holding time (min) | Quenching cooling rate* (° C./sec.) | Cooling stop temperature (° C.) | Tempering treatment: Heating temperature (° C.) | Holding time (min) | Microstructure: Type** | F phase volume fraction (%) | Residual γ phase volume fraction (%) | Remarks |
|---|---|---|---|---|---|---|---|---|---|---|---|
| 17 | N | 990 | 20 | 25 | 25 | 625 | 30 | M + F + γ | 33 | 3 | Invention example |
| 18 | O | 1010 | 20 | 25 | 25 | 625 | 30 | M + F + γ | 34 | 9 | Invention example |
| 19 | P | 1010 | 20 | 25 | 25 | 625 | 30 | M + F + γ | 32 | 9 | Invention example |

*average cooling rate of 800° C. to 500° C.
**M: tempered martensite, M*: martensite, F: ferrite, γ: residual austenite

TABLE 2-2

| Steel tube or pipe No. | Steel No. | Tensile characteristics: Yield strength YS (MPa) | Tensile strength TS (MPa) | Toughness $vE_{-10° C.}$ (J) | Corrosion test: Weight loss corrosion rate (mg/y) | Presence of pitting corrosion | SSC resistance test Presence of cracking | SCC resistance test Presence of cracking | Remarks |
|---|---|---|---|---|---|---|---|---|---|
| 1 | A | 855 | 903 | 173 | 0.01 | none | ○ | ○ | Invention example |
| 2 | B | 913 | 955 | 156 | 0.01 | none | ○ | ○ | Invention example |
| 6 | C | 885 | 942 | 164 | 0.01 | none | ○ | ○ | Invention example |
| 7 | D | 889 | 943 | 166 | 0.01 | none | ○ | ○ | Invention example |
| 8 | E | 900 | 971 | 164 | 0.05 | none | ○ | ○ | Invention example |
| 9 | F | 987 | 1068 | 149 | 0.01 | none | ○ | ○ | Invention example |
| 10 | G | 884 | 929 | 208 | 0.03 | none | ○ | × | Comparative example |
| 11 | H | 764 | 958 | 255 | 0.03 | none | × | × | Comparative example |
| 12 | I | 798 | 1021 | 287 | 0.04 | none | × | × | Comparative example |
| 13 | J | 786 | 982 | 260 | 0.03 | none | × | × | Comparative example |
| 14 | K | 952 | 1063 | 166 | 0.03 | none | × | × | Comparative example |
| 15 | L | 908 | 1109 | 296 | 0.23 | yes | × | × | Comparative example |
| 16 | M | 389 | 726 | 297 | 0.03 | none | × | × | Comparative example |
| 17 | N | 833 | 953 | 176 | 0.01 | none | ○ | ○ | Invention example |
| 18 | O | 830 | 1009 | 198 | 0.02 | none | ○ | ○ | Invention example |
| 19 | P | 863 | 1051 | 197 | 0.01 | none | ○ | ○ | Invention example |

In each of our examples, the resulting high-strength stainless steel seamless tube or pipe had high strength of yield strength: 758 MPa or more, high toughness of absorbed energy at −10° C.: 40 J or more, and excellent corrosion resistance (carbon dioxide gas corrosion resistance) in corrosive environments containing $CO_2$ and $Cl^-$ at a high temperature of 200° C. and further had excellent sulfide stress cracking resistance and excellent sulfide stress corrosion cracking resistance in combination, where cracking (SSC, SCC) did not occur in environments containing $H_2S$. On the other hand, in each of the Comparative examples out of our scope, predetermined high strength was not obtained, carbon dioxide gas corrosion resistance was degraded, or the sulfide stress cracking resistance (SSC resistance) or sulfide stress corrosion cracking resistance (SCC) was degraded.

The invention claimed is:

1. A high-strength stainless steel seamless tube or pipe for oil country tubular goods, comprising a composition containing C: 0.005% to 0.05%, Si: 0.1% to 0.5%, Mn: 0.2% to 1.0%, P: 0.030% or less, S: 0.005% or less, Cr: 15.5% to 17.5%, Ni: 3.0% to 6.0%, Mo: 1.5% to 5.0%, Cu: 4.0% or less, W: 0.1% to 2.5%, N: 0.008% to 0.15%, and the remainder composed of Fe and incidental impurities, on a percent by mass basis, while adjustment is performed such that C, Si, Mn, Cr, Ni, Mo, Cu, and N satisfy formula (1), Cu, Mo, and W satisfy formula (2), and Cu, Mo, W, Cr, and Ni satisfy formula (3), $$-5.9\times(7.82+27C-0.91Si+0.21Mn-0.9Cr+Ni-1.1Mo+0.2Cu+11N)\geq 13.0 \quad (1)$$

$$Cu+Mo+0.5W\geq 5.8 \quad (2)$$

$$Cu+Mo+W+Cr+2Ni\leq 34.5 \quad (3)$$

where C, Si, Mn, Cr, Ni, Mo, Cu, N and W: content of each element (percent by mass).

2. The high-strength stainless steel seamless tube or pipe according to claim 1, comprising a composition further containing at least one group selected from the groups A to D consisting of:

Group A: V: 0.02% to 0.20% on a percent by mass basis

Group B: Al: 0.10% or less on a percent by mass basis

Group C: at least one component selected from Nb: 0.02% to 0.50%, Ti: 0.02% to 0.16%, Zr: 0.50% or less, and B: 0.0030% or less on a percent by mass basis Group D: at least one component selected from REM: 0.005% or less, Ca: 0.005% or less, and Sn: 0.20% or less on a percent by mass basis.

3. The high-strength stainless steel seamless tube or pipe according to claim 2, further comprising a microstructure including a martensite phase as a basic phase and 10% to 60% of ferrite phase, on a volume fraction basis, as a secondary phase.

4. The high-strength stainless steel seamless tube or pipe according to claim 3, wherein the microstructure further includes 30% or less of residual austenite phase on a volume fraction basis.

5. The high-strength stainless steel seamless tube or pipe according to claim 1, further comprising a microstructure including a martensite phase as a basic phase and 10% to 60% of ferrite phase, on a volume fraction basis, as a secondary phase.

6. The high-strength stainless steel seamless tube or pipe according to claim 5, wherein the microstructure further includes 30% or less of residual austenite phase on a volume fraction basis.

7. The high-strength stainless steel seamless tube or pipe according to claim 1, wherein cracking does not occur in a specimen after the following test (a) and wherein cracking does not occur in a specimen after the following test (b):

the test (a) is performed by soaking the specimen in an aqueous solution, in which acetic acid+Na acetate is added to a test solution: 20-percent by mass NaCl aqueous solution (solution temperature: 100° C., atmosphere of $CO_2$ gas at 30 atm and $H_2S$ at 0.1 atm) to adjust the pH to 3.3, held in an autoclave for a soaking period of 720 hours while an applied stress of 100% of the yield stress is applied; and the test (b) is performed by soaking the specimen in an aqueous solution, in which acetic acid+Na acetate is added to a test solution: 20-percent by mass NaCl aqueous solution (solution temperature: 25° C., atmosphere of $CO_2$ gas at 0.9 atm and $H_2S$ at 0.1 atm) to adjust the pH to 3.5, held in an autoclave for a soaking period of 720 hours while an applied stress of 90% of the yield stress is applied.

8. The high-strength stainless steel seamless tube or pipe according to claim 1, wherein W is contained in amount of 0.8% to 2.5%.

9. The high-strength stainless steel seamless tube or pipe according to Claim 1, wherein Mn is contained in amount of 0.25% to 1.0%.

10. A high-strength stainless steel seamless tube or pipe for oil country tubular goods, comprising a composition containing C: 0.005% to 0.05%, Si: 0.1% 0.5%, Mn: 0.15% to 1.0%, P: 0.030% or less, S: 0.005% or less, Cr: 15.5% to 17.5%, Ni: 3.0% to 6.0%, Mo: 1.5% to 5.0%, Cu: 3.5% or less, W: 2.5% or less, N: 0.008% to 0.15%, and the remainder composed of Fe and incidental impurities, on a percent by mass basis, while adjustment is performed such that C, Si, Mn, Cr, Ni, Mo, Cu, and N satisfy formula (1), Cu, Mo, and W satisfy formula (2), and Cu, Mo, W, Cr, and Ni satisfy formula (4), $$-5.9\times(7.82+27C-0.91Si+0.21Mn-0.9Cr+Ni-1.1Mo+0.2Cu+11N)\geq 13.0 \quad (1)$$

$$Cu+MO+0.5W\geq 5.8 \quad (2)$$

$$Cu+Mo+W+Cr+2Ni\leq 31 \quad (4)$$

where C, Si, Mn, Cr, Ni, Mo, Cu, N and W: content of each element (percent by mass).

11. The high-strength stainless steel seamless tube or pipe according to claim 10, comprising a composition further containing at least one group selected from the groups A to D consisting of:

Group A: V: 0.02% to 0.20% on a percent by mass basis

Group B: Al: 0.10% or less on a percent by mass basis

Group C: at least one component selected from Nb: 0.02% to 0.50%, Ti: 0.02% to 0.16%, Zr: 0.50% or less, and B: 0.0030% or less on a percent by mass basis Group D: at least one component selected from REM: 0.005% or less, Ca: 0.005% or less, and Sn: 0.20% or less on a percent by mass basis.

12. The high-strength stainless steel seamless tube or pipe according to claim 11, further comprising a microstructure including a martensite phase as a basic phase and 10% to 60% of ferrite phase, on a volume fraction basis, as a secondary phase.

13. The high-strength stainless steel seamless tube or pipe according to claim 12, wherein the microstructure further includes 30% or less of residual austenite phase on a volume fraction basis.

14. The high-strength stainless steel seamless tube or pipe according to claim 10, further comprising a microstructure including a martensite phase as a basic phase and 10% to 60% of ferrite phase, on a volume fraction basis, as a secondary phase.

15. The high-strength stainless steel seamless tube or pipe according to claim 14, wherein the microstructure further includes 30% or less of residual austenite phase on a volume fraction basis.

16. The high-strength stainless steel seamless tube or pipe according to claim 10, wherein cracking does not occur in a specimen after the following test (a) and wherein cracking does not occur in a specimen after the following test (b):

the test (a) is performed by soaking the specimen in an aqueous solution, in which acetic acid+Na acetate is added to a test solution: 20-percent by mass NaCl aqueous solution (solution temperature: 100° C., atmosphere of $CO_2$ gas at 30 atm and $H_2S$ at 0.1 atm) to adjust the pH to 3.3, held in an autoclave for a soaking period of 720 hours while an applied stress of 100% of the yield stress is applied; and the test (b) is performed by soaking the specimen in an aqueous solution, in which acetic acid+Na acetate is added to a test solution: 20-percent by mass NaCl aqueous solution (solution temperature: 25° C., atmosphere of $CO_2$ gas at 0.9 atm and $H_2S$ at 0.1 atm) to adjust the pH to 3.5, held in an autoclave for a soaking period of 720 hours while an applied stress of 90% of the yield stress is applied.

17. The high-strength stainless steel seamless tube or pipe according to claim 10, wherein W is contained in amount of 0.8% to 2.5%.

18. A method of manufacturing a high-strength stainless steel seamless tube or pipe for oil country tubular goods, comprising:

heating a stainless steel seamless tube or pipe having a composition containing C: 0.005% to 0.05%, Si: 0.1% to 0.5%, Mn: 0.2% to 1.0%, P: 0.030% or less, S: 0.005% or less, Cr: 15.5% to 17.5%, Ni: 3.0% to 6.0%, Mo: 1.5% to 5.0%, Cu: 4.0% or less, W: 0.1% to 2.5%, N: 0.008% to 0.15%, and the remainder composed of Fe and incidental impurities, on a percent by mass basis, while adjustment is performed such that C, Si, Mn, Cr, Ni, Mo, Cu, and N satisfy formula (1), Cu, Mo, and W satisfy formula (2), and Cu, Mo, W, Cr, and Ni satisfy formula (3) to a heating temperature of 850° C. or higher, performing a quenching treatment to cool to a temperature of 50° C. or lower at a cooling rate higher than or equal to the air cooling rate, and performing a tempering treatment to heat to a temperature lower than or equal to the $A_{c1}$ transformation temperature and cool, $$-5.9\times(7.82+27C-0.91Si+0.21Mn-0.9Cr+Ni-1.1Mo+0.2Cu+11N)\geq 13.0 \quad (1)$$

$$Cu+Mo+0.5W\geq 5.8 \quad (2)$$

$$Cu+Mo+W+Cr+2Ni\leq 34.5 \quad (3)$$

where C, Si, Mn, Cr, Ni, Mo, Cu, N and W: content of each element (percent by mass).

19. The method according to claim 18, comprising a composition further containing at least one group selected from the groups A to D consisting of:

Group A: V: 0.02% to 0.20% on a percent by mass basis

Group B: Al: 0.10% or less on a percent by mass basis

Group C: at least one component selected from Nb: 0.02% to 0.50%, Ti: 0.02% to 0.16%, Zr: 0.50% or less, and B: 0.0030% or less on a percent by mass basis Group D: at least one component selected from REM: 0.005% or less, Ca: 0.005% or less, and Sn: 0.20% or less on a percent by mass basis.

20. The method for manufacturing a high-strength stainless steel seamless tube or pipe for oil country tubular goods, according to Claim 18, wherein Mn is contained in amount of 0.25% to 1.0%.

21. A method of manufacturing a high-strength stainless steel seamless tube or pipe for oil country tubular goods, comprising:

heating a stainless steel seamless tube or pipe having a composition containing

C: 0.005% to 0.05%, Si: 0.1% to 0.5%,

Mn: 0.15% to 1.0%, P: 0.030% or less,

S: 0.005% or less, Cr: 15.5% to 17.5%,

Ni: 3.0% to 6.0%, Mo: 1.5% to 5.0%,

Cu: 3.5% or less, W: 2.5% or less,

N: 0.008% to 0.15%, and the remainder composed of Fe and incidental impurities, on a percent by mass basis, while adjustment is performed such that C, Si, Mn, Cr, Ni, Mo, Cu, and N satisfy formula (1), Cu, Mo, and W satisfy formula (2), and Cu, Mo, W, Cr, and Ni satisfy formula (4) to a heating temperature of 850° C. or higher, performing a quenching treatment to cool to a temperature of 50° C. or lower at a cooling rate higher than or equal to the air cooling rate, and performing a tempering treatment to heat to a temperature lower than or equal to the $A_{c1}$ transformation temperature and cool, $$-5.9\times(7.82+27C-0.91Si+0.21Mn-0.9Cr+Ni-1.1Mo+0.2Cu+11N)\geq 13.0 \quad (1)$$

$$Cu+Mo+0.5W\geq 5.8 \quad (2)$$

$$Cu+Mo+W+Cr+2Ni\leq 31 \quad (4)$$

where C, Si, Mn, Cr, Ni, Mo, Cu, N and W: content of each element (percent by mass).

22. The method for manufacturing a high-strength stainless steel seamless tube or pipe for oil country tubular goods, according to claim 21, comprising a composition further containing at least one group selected from the groups A to D consisting of:

Group A: V: 0.02% to 0.20% on a percent by mass basis

Group B: Al: 0.10% or less on a percent by mass basis

Group C: at least one component selected from Nb: 0.02% to 0.50%, Ti: 0.02% to 0.16%, Zr: 0.50% or less, and B: 0.0030% or less on a percent by mass basis Group D: at least one component selected from REM: 0.005% or less, Ca: 0.005% or less, and Sn: 0.20% or less on a percent by mass basis.

* * * * *